US008278604B2

(12) United States Patent
Feng et al.

(10) Patent No.: US 8,278,604 B2
(45) Date of Patent: Oct. 2, 2012

(54) CARBON NANOTUBE HEATER-EQUIPPED ELECTRIC OVEN

(75) Inventors: Chen Feng, Beijing (CN); Kai-Li Jiang, Beijing (CN); Liang Liu, Beijing (CN); Shou-Shan Fan, Beijing (CN)

(73) Assignees: Tsinghua University, Beijing (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 371 days.

(21) Appl. No.: 12/661,134

(22) Filed: Mar. 11, 2010

(65) Prior Publication Data

US 2011/0036826 A1 Feb. 17, 2011

(30) Foreign Application Priority Data

Aug. 14, 2009 (CN) ..... 2009 1 0109334

(51) Int. Cl.
*A21B 1/00* (2006.01)
*A21B 1/22* (2006.01)

(52) U.S. Cl. ..... 219/409; 219/385; 219/391; 219/402; 219/538

(58) Field of Classification Search ..... 219/553, 219/538, 552, 385, 391, 402, 406–411
See application file for complete search history.

(56) References Cited

U.S. PATENT DOCUMENTS

| | | | |
|---|---|---|---|
| 5,698,175 | A | 12/1997 | Hiura et al. |
| 5,788,853 | A | 8/1998 | Zenhausern |
| 5,958,358 | A | 9/1999 | Tenne et al. |
| 6,863,942 | B2 | 3/2005 | Ren et al. |
| 7,077,939 | B1 | 7/2006 | Crooks et al. |
| 7,166,266 | B2 | 1/2007 | Nikolaev et al. |
| 7,355,216 | B2 | 4/2008 | Yang et al. |
| 7,569,850 | B2 | 8/2009 | Noy et al. |
| 7,750,297 | B1 | 7/2010 | Chow et al. |
| 2003/0185741 | A1 | 10/2003 | Matyjaszewski et al. |
| 2004/0034177 | A1 | 2/2004 | Chen |
| 2004/0053780 | A1 | 3/2004 | Jiang et al. |
| 2004/0144970 | A1 | 7/2004 | Wang et al. |
| 2005/0007002 | A1 | 1/2005 | Golovchenko et al. |
| 2005/0208304 | A1 | 9/2005 | Collier et al. |
| 2006/0027555 | A1* | 2/2006 | Aisenbrey ..... 219/385 |
| 2006/0169975 | A1 | 8/2006 | Noy et al. |
| 2006/0204428 | A1 | 9/2006 | Noy et al. |
| 2006/0275956 | A1 | 12/2006 | Konesky |
| 2007/0125761 | A1 | 6/2007 | Nam et al. |
| 2007/0128707 | A1 | 6/2007 | Rorrer et al. |

(Continued)

FOREIGN PATENT DOCUMENTS

| | | |
|---|---|---|
| CN | 1066934 | 12/1992 |

(Continued)

OTHER PUBLICATIONS

Klie et al. Multi-walled carbon nanotubes on amorphous carbon films, Carbon 42 (2004), pp. 1953-1957.

(Continued)

*Primary Examiner* — Angel Roman
(74) *Attorney, Agent, or Firm* — Altis Law Group, Inc.

(57) ABSTRACT

An electric oven includes an oven body defining a chamber. The heater is located in the chamber of the oven body. The heater includes a carbon nanotube structure. The carbon nanotube structure includes a plurality of carbon nanotubes joined end to end by van der Waals attractive force.

20 Claims, 3 Drawing Sheets

U.S. PATENT DOCUMENTS

| | | | | |
|---|---|---|---|---|
| 2007/0137786 | A1 | 6/2007 | Luzzi | |
| 2007/0142559 | A1 | 6/2007 | Wang et al. | |
| 2007/0295714 | A1 | 12/2007 | Liu et al. | |
| 2008/0187648 | A1 | 8/2008 | Hart et al. | |
| 2008/0237464 | A1 | 10/2008 | Zhang et al. | |
| 2008/0251274 | A1 | 10/2008 | Lee et al. | |
| 2009/0085461 | A1 | 4/2009 | Feng et al. | |
| 2010/0126981 | A1* | 5/2010 | Heintz et al. | 219/482 |
| 2011/0036828 | A1* | 2/2011 | Feng et al. | 219/529 |
| 2011/0272392 | A1* | 11/2011 | Dohring et al. | 219/213 |
| 2012/0000899 | A1* | 1/2012 | Eom et al. | 219/385 |

FOREIGN PATENT DOCUMENTS

| | | | |
|---|---|---|---|
| CN | 2462823 | | 12/2001 |
| CN | 1549654 | A | 11/2004 |
| CN | 101090586 | | 12/2007 |
| CN | 101212848 | | 7/2008 |
| CN | 101217097 | | 7/2008 |
| CN | 101276724 | | 10/2008 |
| CN | 101400198 | | 4/2009 |
| JP | 2000-195470 | | 7/2000 |
| JP | 2005249414 | | 9/2005 |
| JP | 2006-147286 | | 6/2006 |
| JP | 2006244742 | | 9/2006 |
| JP | 2008-198407 | | 8/2008 |
| TW | 391482 | | 5/2000 |
| TW | M326535 | | 2/2008 |
| TW | M334291 | | 6/2008 |
| TW | I341878 | | 7/2009 |
| WO | WO2008118486 | | 10/2008 |

OTHER PUBLICATIONS

Zhang et al., "Metal coating on suspended carbon nanotubes and its implication to metal-tube interaction," Chemical physics letters 331 (2000), pp. 35-41.

Xuesong et al., Bottom-up Growth of Carbon Nanotube Multilayers: Unprecedented Grow, Nano Letters (2005), pp. 1997-2000.

Zhu et al., Aligned Carbon Nanotube Stacks by Water-Assisted Selective Etching, Nano Letters, (2005), pp. 2641-2645.

Zhu et al., The growth of carbon nanotube stacks in the kinetics controlled regime, Science Direct, (2006) pp. 344-348.

Zhang et al., "Formation of metal nanowires on suspended single-walled carbon nanotubes", Applied physics letters vol. 77, No. 19. Nov. 2000.

Jiang Kai-Li et al. "Continuous carbon nanotube yarns and their applications" Physics, Aug. 2003, vol. 32, No. 8, p. 506-510, Section 2, the second paragraph of Section 4, Figure 1f and Figure 3a may be relevant.

* cited by examiner

CARBON NANOTUBE HEATER-EQUIPPED ELECTRIC OVEN

CROSS-REFERENCE

This application claims all benefits accruing under 35 U.S.C. §119 from China Patent Application No. 200910109334.1, filed on Aug. 14, 2009 in the China Intellectual Property Office, disclosure of which is incorporated herein by reference.

BACKGROUND

1. Technical Field

The present disclosure generally relates to electric ovens, particularly, an oven equipped with a carbon nanotube heater.

2. Description of Related Art

An electric oven generally cooks food by elevating the temperature inside the oven using electricity. The heater used in the oven is often made of metal such as tungsten. Metals with good heat conductivity can generate tremendous heat, even at a low applied voltage. However, metals are prone to oxidization, thereby reducing the service life of the oven. Furthermore, the metals used add considerable weight to the oven.

What is needed therefore, is an electric oven with a carbon nanotube heater.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
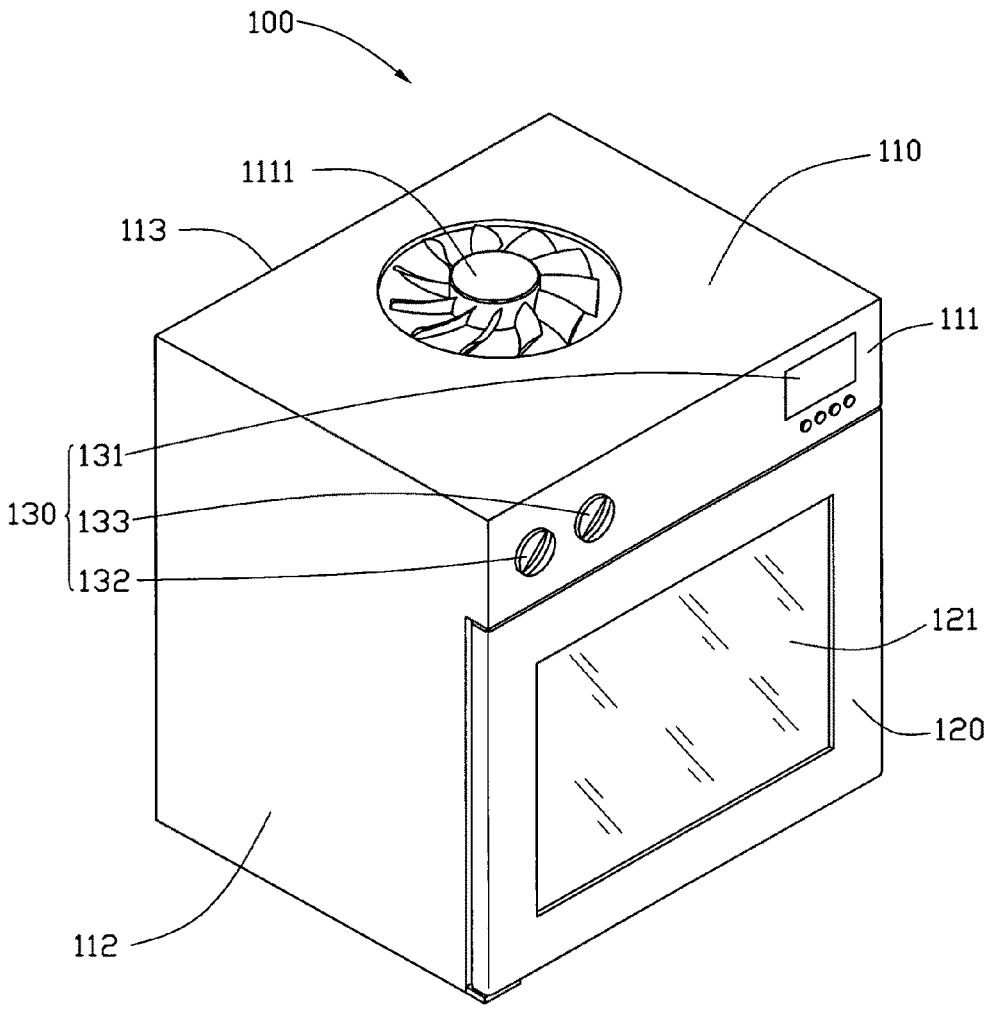
FIG. 1 is a schematic structural view of one embodiment of an oven, shown when an oven door of the oven is closed.
Figure 2:
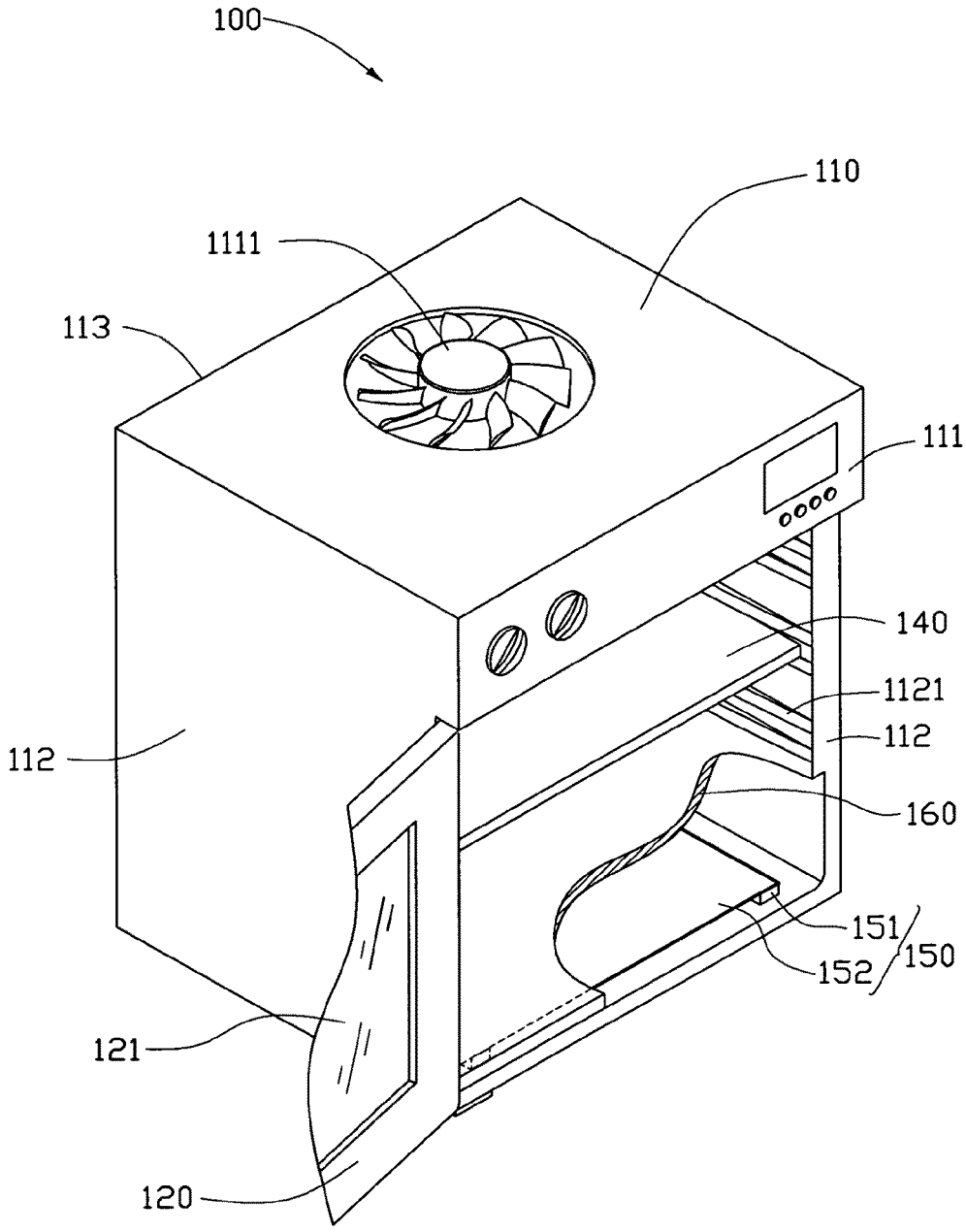
FIG. 2 is a schematic structural view of one embodiment of an oven, shown when the oven door is opened.

Referring to FIG. 1 and FIG. 2, an oven 100 of an embodiment includes an oven body 110, an oven door 120, a controlling element 130, a loading element 140, a heater 150, and a protective layer 160. The oven 100 is used for baking or roasting food. The oven door 120 is pivotably connected to the oven body 110. The controlling element 130 is configured for controlling a cooking temperature and a cooking time of the food. The loading element 140 is configured for loading the food. The heater 150 and the protective layer 160 are installed in the oven body 110.

The oven body 110 defines a cavity. The oven door 120 can cover the cavity to define a closed cooking chamber. A shape of the cooking chamber is not limited. In one embodiment, the cooking chamber is a cubic chamber. The oven body 110 can include two opposite first sidewalls 111, two opposite second sidewalls 112 and a rear sidewall 113. The first sidewalls 111 are located apart from and opposite each other. The second sidewalls 112 are located apart from and opposite each other. The second sidewalls 112 are connected to side edges of the first sidewalls 111. The rear sidewall 113 is connected to ends of the first sidewalls 111 and the second sidewalls 112. A plurality of pairs of rack guides 1121 arranged along a vertical direction is mounted on two opposite second sidewalls 112. The rack guides 1121 are configured for supporting both side edges of the loading element 140. A convection fan 1111 can be mounted on one sidewall of the oven body 110 to circulate air in the cooking chamber. In one embodiment, the convection fan 1111 is mounted on one first sidewall 111.

The first sidewall 111, the second sidewall 112, and the rear sidewall 113 can be made of an adiabatic material or have an adiabatic structure. Thus, the sidewalls 111, 112, 113 can have a good adiabatic property. The adiabatic material can be a heat-resistant glass, heat-resistant plastic, quartz, or combinations thereof. The adiabatic structure can include an inner wall and an outer wall opposite the inner wall. The inner wall and the outer wall can be located apart from each other to define an adiabatic space therebetween. A thermal insulating material can also be positioned to the adiabatic space to improve the adiabatic property of the sidewalls 111, 112, 113. Simultaneously, the thermal insulating material can be sandwiched between the inner wall and the outer wall. The thermal insulating material can be pearlite, foam glass, porous concrete, or combinations thereof.

To decrease the amount of heat absorbed by the oven body 110, an infrared (IR) reflecting layer having an IR reflecting coefficient higher than 30 percent can be disposed on an inner surface of the oven body 110. A material of the IR reflecting layer can be metal, metal compound, alloy, composite material, or combinations thereof. The metal can be chromium, zinc, aluminum, gold, silver, or combinations thereof. The alloy can be aluminum-zinc alloy. The composite material can be a paint including zinc oxide. An IR reflecting coefficient of the reflecting material can be higher than about 30 percent to maintain good reflective ability. For example, the IR reflecting coefficient of the IR reflecting layer made of zinc can be higher than about 38 percent. The IR reflecting coefficient of the IR reflecting layer made of the aluminum-zinc alloy can be higher than about 75 percent. The IR reflecting layer is an optional, omissible structure.

The oven door 120 is pivotably mountable on a front portion of the oven body 110 to open and close the cavity. To enable good adiabatic property, a structure and material of the oven door 120 can be similar to the structure and material of the oven body 110. A transparent window 121 can also be disposed on the oven door 120. The transparent window 121 can be configured for observing the cooked food in the cooking chamber. The transparent window 121 can have a good heat-resistant and transparent property. A material of transparent window 121 can be a transparent heat-resistant glass, a transparent heat-resistant plastic, or combinations thereof.

The controlling element 130 can be installed on any portion of the oven body 110 as desired, such as the oven door 120, one first sidewall 111, or one second sidewall 112. In one embodiment, the controlling element 130 is assembled on one end of one first sidewall 111 and electrically connected to the heater 150. The controlling element 130 can include a power switch 131, a temperature button 132, and a timing button 133. The power switch 131 is an on-off power control for an electrical connection with the heater 150 and a power source. The temperature button 132 can be configured for controlling the temperature of the cooking chamber. The timing button 133 can be configured for setting the cooking time of the food.

The loading element 140 is received in the cooking chamber of the oven body 110. The loading element 140 can be a plate, a tray, a wire rack with a plurality of meshes, or any other elements capable of holding the food thereon. In one embodiment, the loading element 140 is a plate. The loading element 140 can have an upper surface loading the food thereon, and a lower surface opposite the upper surface. The loading element 140 can be slidably installed in one or more selective rack guides to change its vertical position. The loading element 140 is capable of sliding along with the rack guides 1121 whereupon the loading element 140 is insertable into, or drawn out from the cooking chamber.

The heater 150 includes two electrodes 151 and a carbon nanotube structure 152. The two electrodes 151 are electrically connected to the carbon nanotube structure 152.

The two electrodes 151 can be disposed on a same surface or two opposite surfaces of the carbon nanotube structure 152. The two electrodes 151 can be directly and electrically attached to the carbon nanotube structure 152 by, for example, a conductive adhesive (not shown), such as silver adhesive. Because some of the carbon nanotube structures 152 have large specific surface area and are adhesive in nature, in some embodiments, the two electrodes 151 can be adhered directly to the carbon nanotube structures 152. It should be noted that any other bonding methods may be adopted as long as the two electrodes 151 are electrically connected to the carbon nanotube structures 152. The material of the two electrodes 151 can be metal, conductive resin, or any other suitable material. The shapes of the two electrodes 151 are not limited and can be lamellar, rod, wire, and block shaped among other shapes. The heater 150 can include two or more electrodes 151. In one embodiment, the heater 150 includes two electrodes 151. The two electrodes 151 are lamellar and substantially parallel to each other and disposed on the two opposite ends of the carbon nanotube structure 152. The two electrodes 151 and the oven body 110 are kept insulated from each other.

The carbon nanotube structure 152 includes a plurality of carbon nanotubes uniformly distributed therein, and the carbon nanotubes therein can be joined by van der Waals attractive force therebetween. The carbon nanotube structure 152 can be a substantially pure structure of the carbon nanotubes, with few impurities. The carbon nanotubes can be used to form many different structures and provide a large specific surface area. The heat capacity per unit area of the carbon nanotube structure 152 can be less than $2\times10^{-4}$ J/m$^2$*K. Typically, the heat capacity per unit area of the carbon nanotube structure 152 is less than $1.7\times10^{-6}$ J/m$^2$*K. Because the heat capacity of the carbon nanotube structure 152 is very low, the temperature of the heater 150 can rise and fall quickly, significantly raising the heat exchange efficiency of heater 150. If the carbon nanotube structure 152 is substantially pure, the carbon nanotubes do not easily oxidize and the life of the heater 150 or the oven 100 employing the heater 150 can be prolonged. Further, the carbon nanotubes have a low density, about 1.35 g/cm$^3$, thus the weight of the heater 150 or the oven 100 employing the heater 150 is light. Because the heat capacity of the carbon nanotube structure 152 is very low, the heater 150 has a high response heating speed. Because the carbon nanotube has a large specific surface area, the carbon nanotube structure 152 with a plurality of carbon nanotubes also has a large specific surface area. If the specific surface of the carbon nanotube structure 152 is large enough, the carbon nanotube structure 152 is adhesive and can be directly applied to a surface of the oven body 110.

The carbon nanotubes in the carbon nanotube structure 152 can be orderly or disorderly arranged. The term 'disordered carbon nanotube structure' refers to a structure where the carbon nanotubes are arranged along many different directions, and the aligning directions of the carbon nanotubes are random. The number of the carbon nanotubes arranged along each different direction can be almost the same (e.g. uniformly disordered). The disordered carbon nanotube structure 152 can be isotropic. The carbon nanotubes in the disordered carbon nanotube structure 152 can be entangled with each other.

The carbon nanotube structure 152 including ordered carbon nanotubes is an ordered carbon nanotube structure 152. The term 'ordered carbon nanotube structure' refers to a structure where the carbon nanotubes are arranged in a consistently systematic manner, e.g., the carbon nanotubes are arranged approximately along a same direction and/or have two or more sections within each of which the carbon nanotubes are arranged approximately along a same direction (different sections can have different directions). The carbon nanotubes in the carbon nanotube structure 152 can be single-walled, double-walled, and/or multi-walled carbon nanotubes.

The carbon nanotube structure 152 can be a carbon nanotube film structure with a thickness ranging from about 0.5 nanometers to about 1 millimeter. The carbon nanotube film structure can include at least one carbon nanotube film. The carbon nanotube structure 152 can also be a linear carbon nanotube structure with a diameter ranging from about 0.5 nanometers to about 1 millimeter. The carbon nanotube structure 152 can also be a combination of the carbon nanotube film structure and the linear carbon nanotube structure. It is understood that any carbon nanotube structure 152 described can be used with all embodiments. It is further understood that any carbon nanotube structure 152 may or may not employ the use of a support structure.

Figure 3:
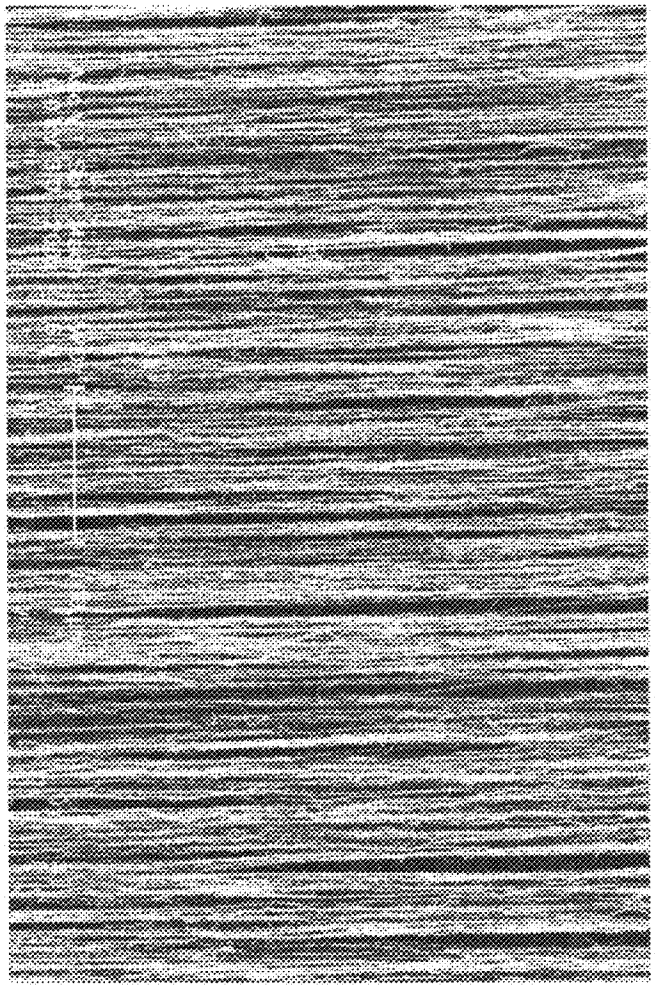
FIG. 3 shows a Scanning Electron Microscope (SEM) image of a drawn carbon nanotube film.

In one embodiment, the carbon nanotube film structure includes at least one drawn carbon nanotube film. A film can be drawn from a carbon nanotube array, to form a drawn carbon nanotube film. Examples of drawn carbon nanotube film are taught by U.S. Pat. No. 7,045,108 to Jiang et al., and WO 2007015710 to Zhang et al. The drawn carbon nanotube film includes a plurality of carbon nanotubes that can be arranged substantially parallel to a surface of the drawn carbon nanotube film as shown in FIG. 3. A large number of the carbon nanotubes in the drawn carbon nanotube film can be oriented along a preferred orientation, meaning that a large number of the carbon nanotubes in the drawn carbon nanotube film are arranged substantially along the same direction. An end of one carbon nanotube is joined to another end of an adjacent carbon nanotube arranged substantially along the same direction, by van der Waals attractive force. A small number of the carbon nanotubes are randomly arranged in the drawn carbon nanotube film, and has a small if not negligible effect on the larger number of the carbon nanotubes in the drawn carbon nanotube film arranged substantially along the same direction. The carbon nanotube film can be capable of forming a free standing structure. The term "free standing structure" can be defined as a structure that does not have to be supported by a substrate. For example, a free standing structure can sustain the weight of itself when it is hoisted by a portion thereof without any significant damage to its structural integrity. So, if the drawn carbon nanotube film is placed between two separate supporters, a portion of the drawn carbon nanotube film, not in contact with the two supporters, would be suspended between the two supporters and yet maintain film structural integrity. The free standing structure of the drawn carbon nanotube film is realized by the successive carbon nanotubes joined end to end by van der Waals attractive force.

Understandably, some variation can occur in the orientation of the carbon nanotubes in the drawn carbon nanotube film as can be seen in FIG. 3. Microscopically, the carbon nanotubes oriented substantially along the same direction may not be perfectly aligned in a straight line, and some curve portions may exist. Furthermore, it can be understood that some carbon nanotubes located substantially side by side and oriented along the same direction and in contact with each other can not be excluded. More specifically, the drawn carbon nanotube film includes a plurality of successively oriented carbon nanotube segments joined end-to-end by van der Waals attractive force therebetween. Each carbon nanotube segment includes a plurality of carbon nanotubes substantially parallel to each other, and joined by van der Waals attractive force therebetween. The carbon nanotube segments can vary in width, thickness, uniformity and shape. The carbon nanotubes in the drawn carbon nanotube film are also substantially oriented along a preferred orientation.

The carbon nanotube film structure of the heater 150 can include at least two stacked carbon nanotube films. In other embodiments, the carbon nanotube structure 152 can include two or more coplanar carbon nanotube films, and layers of coplanar carbon nanotube films. Additionally, when the carbon nanotubes in the carbon nanotube film are aligned along one preferred orientation (e.g., the drawn carbon nanotube film), an angle can exist between the orientations of carbon nanotubes in adjacent films, whether stacked or adjacent. Adjacent carbon nanotube films can be combined by only van der Waals attractive forces therebetween. The number of the layers of the carbon nanotube films is not limited by the length of the carbon nanotube structure 152. However, the thicker the carbon nanotube structure 152, the lower the specific surface area. An angle between the aligned directions of the carbon nanotubes in two adjacent carbon nanotube films can range from about 0 degrees to about 90 degrees. If the angle between the aligned directions of the carbon nanotubes in adjacent carbon nanotube films is larger than 0 degrees, a microporous structure is defined by the carbon nanotubes in the heater 150. The carbon nanotube structure 152 in an embodiment employing these films will have a plurality of micropores. Stacking the carbon nanotube films will also add to the structural integrity of the carbon nanotube structure 152.

In another embodiment, the carbon nanotube film structure includes a flocculated carbon nanotube film. The flocculated carbon nanotube film can include a plurality of long, curved, disordered carbon nanotubes entangled with each other. Further, the flocculated carbon nanotube film can be isotropic. The carbon nanotubes can be substantially uniformly dispersed in the carbon nanotube film. Adjacent carbon nanotubes are acted upon by van der Waals attractive force to form an entangled structure with micropores defined therein. It is understood that the flocculated carbon nanotube film is very porous. Sizes of the micropores can be less than 10 micrometers. The porous nature of the flocculated carbon nanotube film will increase the specific surface area of the carbon nanotube structure 152. Further, because the carbon nanotubes in the carbon nanotube structure 152 are entangled with each other, the carbon nanotube structure 152 employing the flocculated carbon nanotube film has excellent durability, and can be fashioned into desired shapes with a low risk to the integrity of the carbon nanotube structure 152. The thickness of the flocculated carbon nanotube film can range from about 0.5 nanometers to about 1 millimeter.

In another embodiment, the carbon nanotube film structure can include at least a pressed carbon nanotube film. The pressed carbon nanotube film can be a free standing carbon nanotube film. The carbon nanotubes in the pressed carbon nanotube film are arranged along a same direction or arranged along different directions. The carbon nanotubes in the pressed carbon nanotube film can rest upon each other. Adjacent carbon nanotubes are attracted to each other and combined by van der Waals attractive force. An angle between a primary alignment direction of the carbon nanotubes and a surface of the pressed carbon nanotube film is 0 degrees to approximately 15 degrees. The greater the pressure applied, the smaller the angle formed. If the carbon nanotubes in the pressed carbon nanotube film are arranged along different directions, the carbon nanotube structure 152 can be isotropic. The thickness of the pressed carbon nanotube film ranges from about 0.5 nanometers to about 1 millimeters. Examples of pressed carbon nanotube film are taught by US application 20080299031A1 to Liu et al.

In other embodiments, the linear carbon nanotube structure includes carbon nanotube wires and/or carbon nanotube cables.

The carbon nanotube wire can be untwisted or twisted. Treating the drawn carbon nanotube film with a volatile organic solvent can form the untwisted carbon nanotube wire. Specifically, the organic solvent is applied to soak the entire surface of the drawn carbon nanotube film. During the soaking, adjacent parallel carbon nanotubes in the drawn carbon nanotube film will bundle together, due to the surface tension of the organic solvent as it volatilizes, and thus, the drawn carbon nanotube film will be shrunk into untwisted carbon nanotube wire. The untwisted carbon nanotube wire includes a plurality of carbon nanotubes substantially oriented along a same direction (i.e., a direction along the length of the untwisted carbon nanotube wire). The carbon nanotubes are substantially parallel to the axis of the untwisted carbon nanotube wire. More specifically, the untwisted carbon nanotube wire includes a plurality of successive carbon nanotube segments joined end to end by van der Waals attractive force therebetween. Each carbon nanotube segment includes a plurality of carbon nanotubes substantially parallel to each other, and combined by van der Waals attractive force therebetween. The carbon nanotube segments can vary in width, thickness, uniformity and shape. Length of the untwisted carbon nanotube wire can be arbitrarily set as desired. A diameter of the untwisted carbon nanotube wire ranges from about 0.5 nanometers to about 100 micrometers.

The twisted carbon nanotube wire can be formed by twisting a drawn carbon nanotube film using a mechanical force to turn the two ends of the drawn carbon nanotube film in opposite directions. The twisted carbon nanotube wire includes a plurality of carbon nanotubes helically oriented around an axial direction of the twisted carbon nanotube wire. More specifically, the twisted carbon nanotube wire includes a plurality of successive carbon nanotube segments joined end to end by van der Waals attractive force therebetween. Each carbon nanotube segment includes a plurality of carbon nanotubes parallely aligned and combined by van der Waals attractive force therebetween. The length of the carbon nanotube wire can be set as desired. A diameter of the twisted carbon nanotube wire can be from about 0.5 nanometers to about 100 micrometers. Further, the twisted carbon nanotube wire can be treated with a volatile organic solvent after being twisted. After being soaked by the organic solvent, the adjacent paralleled carbon nanotubes in the twisted carbon nanotube wire will bundle together, due to the surface tension of the organic solvent when the organic solvent volatilizes. The specific surface area of the twisted carbon nanotube wire will decrease, while the density and strength of the twisted carbon nanotube wire will be increased.

The carbon nanotube cable includes two or more carbon nanotube wires. The carbon nanotube wires in the carbon nanotube cable can be twisted or untwisted. In an untwisted carbon nanotube cable, the carbon nanotube wires are substantially parallel to each other. In a twisted carbon nanotube cable, the carbon nanotube wires are twisted with each other.

The heater 150 can include a plurality of linear carbon nanotube structures. The plurality of linear carbon nanotube structures can be parallely aligned, interwoven, or twisted with each other. The resulting structure can be a planar structure if so desired.

The heater 150 can also include a matrix enclosing the entire carbon nanotube structure 152 therein. The matrix combines the carbon nanotubes of the carbon nanotube structures 152 thereby forming a carbon nanotube composite structure. Alternatively, the carbon nanotube structure 152 includes a plurality of micropores and the matrix is dispersed or permeated in the micropores of the carbon nanotube structure 152. A material of the matrix can be a polymer, an inorganic, a non-metal, or combinations thereof. The material of the matrix can be liquid or gas at a set temperature enabling the material of the matrix to infiltrate the micropores of the carbon nanotube structure 152 during composition of the carbon nanotube structure. The matrix has good thermal stability and is not easily distorted, melted and/or decomposed under a working temperature of the heater 150.

Examples of polymers are cellulose, polyethylene, polypropylene, polystyrene, polyvinyl chloride (PVC), ethoxyline resin, phenol formaldehyde resin, silica gel, polyester, polyethylene terephthalate (PET), polymethyl methacrylate (PMMA), and combinations thereof. Examples of inorganic non-metals are glass, ceramic, semiconductor, and combinations thereof.

The matrix in the micropores of the carbon nanotube structure 152 can combine the carbon nanotubes of the carbon nanotube structure 152 and prevent the carbon nanotubes from separating. If the entire carbon nanotube structure 152 is enclosed within the matrix, the matrix can protect the carbon nanotube structure 152 from outside contaminants. If the material of the matrix is insulative, the matrix can electrically insulate the carbon nanotube structure 152 from the external environment. The matrix allows the heat in the heater 150 to be dispersed uniformly. The matrix can further slow down the temperature changing speed of the heater 150. When the matrix is made of flexible polymer, the flexibility of the heater 150 can be improved. The matrix is an optional structure, and thus omissible.

A protective layer 160 can also be disposed between the heater 150 and the loading element 140. In one embodiment, the protective layer 160 covers a top surface of the carbon nanotube structure 152. A material of the protective layer 160 can be electric or insulative. The electric material can be a metal or alloy. The insulative material can be resin, plastic, or rubber. A thickness of the protective layer can range from about 0.5 micrometers to about 2 millimeters. The protective layer 160 can protect the carbon nanotube structure 152 from outside contaminants. The protective layer 160 is an optional structure and, thus omissible.

When the oven 100 is in operation, a voltage is applied to the two electrodes 151, and the carbon nanotube structure 152 of the heater 150 radiates heat at a certain wavelength. The food loaded on the loading element 140 can be roasted by the heater 150. By controlling the specific surface area of the carbon nanotube structure 152 and varying the voltage and the thickness of the carbon nanotube structure 152, the carbon nanotube structure 152 emits heat at different wavelengths. If the voltage is determined at a certain value, the greater the thickness of carbon nanotube structure 152, the shorter the wavelength of the electromagnetic waves. Further, if the thickness of the carbon nanotube structure 152 is determined at a certain value, the greater the voltage applied to the electrode, the shorter the wavelength of the electromagnetic waves. As such, the heater 150 can be regulated to emit a visible light and create general thermal radiation or emit IR radiation.

Because carbon nanotubes of the carbon nanotube structure 152 have an ideal black body structure, the heater 150 has long radiation distance and high efficiency of heat exchange. If the distance between the food and the heater 150 is determined, the heater 150 has a lower energy consumption compared to conventional ovens adopting a metal wire heater. The food can be evenly heated by the heater 150.

Finally, it is to be understood that the above-described embodiments are intended to illustrate rather than limit the disclosure. Variations may be made to the embodiments without departing from the spirit of the disclosure as claimed. Elements associated with any of the above embodiments are envisioned to be associated with any other embodiments. The above-described embodiments illustrate the scope of the disclosure but do not restrict the scope of the disclosure.

What is claimed is:

1. An oven, comprising:

an oven body defining a chamber;

an oven door pivotably mounted on the oven body to seal the chamber; and a heater located in the chamber of the oven body, the heater comprising a carbon nanotube structure, at least two electrodes electrically connected to the carbon nanotube structure, the carbon nanotube structure comprising a plurality of carbon nanotubes joined end to end by wan der Waals attractive force.

2. The oven of claim 1, wherein a heat capacity per unit area of the carbon nanotube structure is less than or equal to $1.7\times10^{-6}$ J/cm$^2$*K.

3. The oven of claim 1, wherein the carbon nanotube structure is a substantially pure structure of carbon nanotubes.

4. The oven of claim 3, wherein the carbon nanotubes are orderly arranged in the carbon nanotube structure.

5. The oven of claim 1, wherein the carbon nanotube structure comprises at least one drawn carbon nanotube film comprising the carbon nanotubes.

6. The oven of claim 5, wherein the carbon nanotubes of the at least one drawn carbon nanotube film, form successively oriented carbon nanotube segments joined end-to-end by van der Waals attractive force therebetween, and the carbon nanotubes are substantially oriented along a same direction.

7. The oven of claim 6, wherein the carbon nanotubes in each carbon nanotube segment are substantially parallel to each other.

8. The oven of claim 5, wherein the carbon nanotube structure comprises two or more stacked coplanar carbon nanotube films, each of the carbon nanotube films comprising the plurality of carbon nanotubes substantially oriented along a same direction.

9. The oven of claim 8, wherein an angle between the aligned directions of the carbon nanotubes in adjacent carbon nanotube films is about 0 degrees to about 90 degrees.

10. The oven of claim 1, wherein a first electrode of the at least two electrodes is located at one end of the carbon nanotube structure, and a second electrode of the at least two electrodes is located at an opposite end of the carbon nanotube structure.

11. The oven of claim 1, wherein the heater is insulatively connected to the oven body.

12. The oven of claim 1, further comprising a matrix enclosing the carbon nanotube structure therein.

13. The oven of claim 12, wherein the carbon nanotube structure defines a plurality of micropores; the matrix is present in some of the plurality of micropores.

14. The oven of claim 1, further comprising a heat-reflecting layer disposed on an inner surface of the oven body.

15. The oven of claim 1, further comprising a loading element received in the chamber of the oven body and located apart from the heater.

16. The oven of claim 15, further comprising a protective layer disposed between the heater and the loading element.

17. The oven of claim 15, wherein the oven body comprises a rack guide disposed on an inner surface of the cavity, the loading element slidably engaging with the rack guide.

18. The oven of claim 15, wherein the oven body comprises two opposite sidewalls each having a rack guide disposed thereon, the loading element slidably engaging in the rack guides.

19. An oven, comprising:

a cooking chamber;

a loading element for supporting food, the loading element being inserted in the cooking chamber;

a heater received in the cooking chamber;

wherein the heater comprises a carbon nanotube structure, the carbon nanotube structure comprises a plurality of carbon nanotubes joined by wan der Waals attractive force.

20. The oven of claim 19, wherein the carbon nanotube structure is a carbon nanotube film comprising the carbon nanotubes substantially oriented along a same direction; the heater further comprises at least two electrodes connected to the carbon nanotube film.

* * * * *